US008654069B2

(12) United States Patent
Mamba et al.

(10) Patent No.: US 8,654,069 B2
(45) Date of Patent: Feb. 18, 2014

(54) DISPLAY DEVICE

(75) Inventors: Norio Mamba, Kawasaki (JP); Tsutomu Furuhashi, Yokohama (JP); Shinichi Komura, Mobara (JP)

(73) Assignees: Hitachi Displays, Ltd., Chiba (JP); Panasonic Liquid Crystal Display Co., Ltd., Hyogo-Ken (JP)

( * ) Notice: Subject to any disclaimer, the term of this patent is extended or adjusted under 35 U.S.C. 154(b) by 976 days.

(21) Appl. No.: 12/026,580

(22) Filed: Feb. 6, 2008

(65) Prior Publication Data

US 2008/0238817 A1 Oct. 2, 2008

(30) Foreign Application Priority Data

Mar. 26, 2007 (JP) ..... 2007-078693

(51) Int. Cl.
*G09G 3/36* (2006.01)
*G09G 3/20* (2006.01)

(52) U.S. Cl.
USPC ..... 345/103; 345/55; 345/92

(58) Field of Classification Search
USPC ..... 345/87–104, 55; 349/33–48
See application file for complete search history.

(56) References Cited

U.S. PATENT DOCUMENTS

| | | | | |
|---|---|---|---|---|
| 7,158,201 | B2 | 1/2007 | Kim et al. | |
| 7,495,735 | B2 | 2/2009 | Kim et al. | |
| 7,714,823 | B2 * | 5/2010 | Chen et al. | 345/87 |
| 7,852,442 | B2 | 12/2010 | Kim et al. | |
| 7,876,410 | B2 | 1/2011 | Hsu et al. | |
| 8,102,493 | B2 | 1/2012 | Li et al. | |
| 8,125,599 | B2 | 2/2012 | Kim et al. | |
| 2005/0030460 | A1 * | 2/2005 | Kim et al. | 349/139 |
| 2005/0200788 | A1 | 9/2005 | Edwards | |
| 2006/0103800 | A1 * | 5/2006 | Li et al. | 349/129 |
| 2012/0057117 | A1 | 3/2012 | Li et al. | |
| 2012/0154702 | A1 | 6/2012 | Kim et al. | |

FOREIGN PATENT DOCUMENTS

| | | |
|---|---|---|
| CN | 1920649 | 2/2007 |
| JP | 5-188395 | 7/1993 |
| JP | 5-265045 | 10/1993 |
| JP | 2005-4212 | 1/2005 |
| JP | 2006-500617 | 1/2006 |
| JP | 2006-126842 | 5/2006 |

OTHER PUBLICATIONS

Office Action issued in Chinese Patent Application No. 2008100048908 on Dec. 18, 2009.
Office Action issued in Japanese Patent Application No. 2007-078693 on Jul. 6, 2011.
Office Action issued in Japanese Patent Application No. 2007-078693 on Mar. 16, 2011.

* cited by examiner

*Primary Examiner* — Kenneth Bukowski
(74) *Attorney, Agent, or Firm* — Antonelli, Terry, Stout & Kraus, LLP.

(57) ABSTRACT

In a display device, pixel electrodes I, II and III corresponding to color filters R, G and B are coupled to TFTs which are turned on in accordance with signals on gate lines G, and the drain (source) of the TFT coupled to the pixel electrode II is connected with the source (drain) of the TFT coupled to the pixel electrode III. A signal voltage is written in the pixel electrode I when the gate line G1*a* is in the "on" state, a signal voltage is written in the pixel electrode II when the gate line G1*b* is in the "on" state, and a signal voltage is written in the pixel electrode III when the gate lines G1*a* and G1*b* are both in the "on" state. Signal voltages are written in the pixel electrodes III, I and II in this order mentioned.

7 Claims, 14 Drawing Sheets

DISPLAY DEVICE

CLAIMS OF PRIORITY

The present application claims priority from Japanese application serial no. 2007-078693 filed on Mar. 26, 2007, the content of which is hereby incorporated by reference into this application.

FIELD OF THE INVENTION

This invention relates to a display device having picture display elements or pixels arranged in the form of matrix, and more particularly to the structure of pixel electrodes which are driven in a time division fashion in a liquid crystal display (LCD) device.

BACKGROUND OF THE INVENTION

Of all the display devices recently developed, LCD devices, irrespective of their sizes, are rapidly increasing in number of applications. In an ordinary LCD device, pixels arranged in the form of matrix are driven by selectively energizing one of scanning lines (i.e. gate lines) and by applying signal voltages to the pixels from signal lines (i.e. data lines). Accordingly, each pixel is controlled by a single scanning line and a single signal line.

JP-A-5-188395 discloses an LCD device wherein two pixels are electrically connected with a single signal line, one of the two pixels is controlled by a gate line, and the other pixel is controlled by the gate line and another gate line adjacent to the gate line, so that the number of the used signal lines can be halved.

JP-A-5-265045 discloses an LCD device wherein a signal voltage is applied in a time division manner through a single signal line to two pixels controlled by two adjacent gate lines so that the number of the used signal lines can be halved.

In the LCD device disclosed in JP-A-5-188395, wiring conductors for sending gate signals and signal voltages through them are to be laid out in pixels controlled by two thin film transistors (TFTs) and therefore the aperture, i.e. ratio of light emitting area within a pixel to the entire area of the pixel, will become smaller. In the LCD device disclosed in JP-A-5-265045, on the other hand, even when a signal is sent through a single signal line to two pixels, the number of the gate lines increases so that the aperture is adversely affected. Also, in both LCD devices disclosed in JP-A-5-188395 and JP-A-5-265045, a signal voltage is applied to two pixels through a single signal line. Accordingly, these types of LCD devices can be adapted to at best the double division drive method. As a result, if these devices are to be used with an LSI for the triple division drive (RGB time division drive wherein R, G and B signal voltages are sent through a single line in a time division manner) which has been increasingly put to practice, the resultant circuit structure will be complicated.

SUMMARY OF THE INVENTION

One feature of this invention is to supply signals to three pixels through a single signal line by differentiating the selected conditions (on-off conditions) with respect to two adjacent gate lines. Namely, let there be two adjacent gate lines a and b. Then, one of the three pixels is selectively controlled when only the gate line a is turned on, another pixel is selectively controlled when only the gate line b is turned on, and the remaining pixel is selectively controlled when both the gate lines a and b are turned on.

Another feature of this invention is to use a pixel electrode as a path for supplying signal voltages from signal lines to TFTs connected with three pixels.

According to this invention roughly described above, the following advantages (1) through (7) can be enjoyed.

(1) Since the number of signal lines can be reduced, the aperture will be increased.

(2) Since the number of necessary wiring conductors for each pixel can be reduced, a very fine display panel can be realized.

(3) Since the number of signal lines can be reduced, the number of the terminals of the peripheral circuits can be reduced so that production cost can be reduced. At the same time, since the number of connections of wiring conductors can be reduced, the probability of occurrence of faults can also be reduced.

(4) Since signal voltages can be distributed to three pixels through a single signal line, an LSI for RGB time division drive can be adaptively used so that cost will be suppressed.

(5) Since transparent pixel electrodes can be used when a signal voltage is to be transferred within a pixel, a very fine display panel can be realized without decreasing the aperture.

(6) With a fixed number of wiring conductors, the fineness of display panel can be improved by increasing the number of pixels.

(7) With a fixed number of pixels, the aperture can be increased by decreasing the number of wiring conductors.

Other objects, features and advantages of the invention will become apparent from the following description of the embodiments of the invention taken in conjunction with the accompanying drawings.

DESCRIPTION OF THE EMBODIMENTS

Embodiments of this invention will now be described with reference to the attached drawings.

[Embodiment 1]

Figure 1:
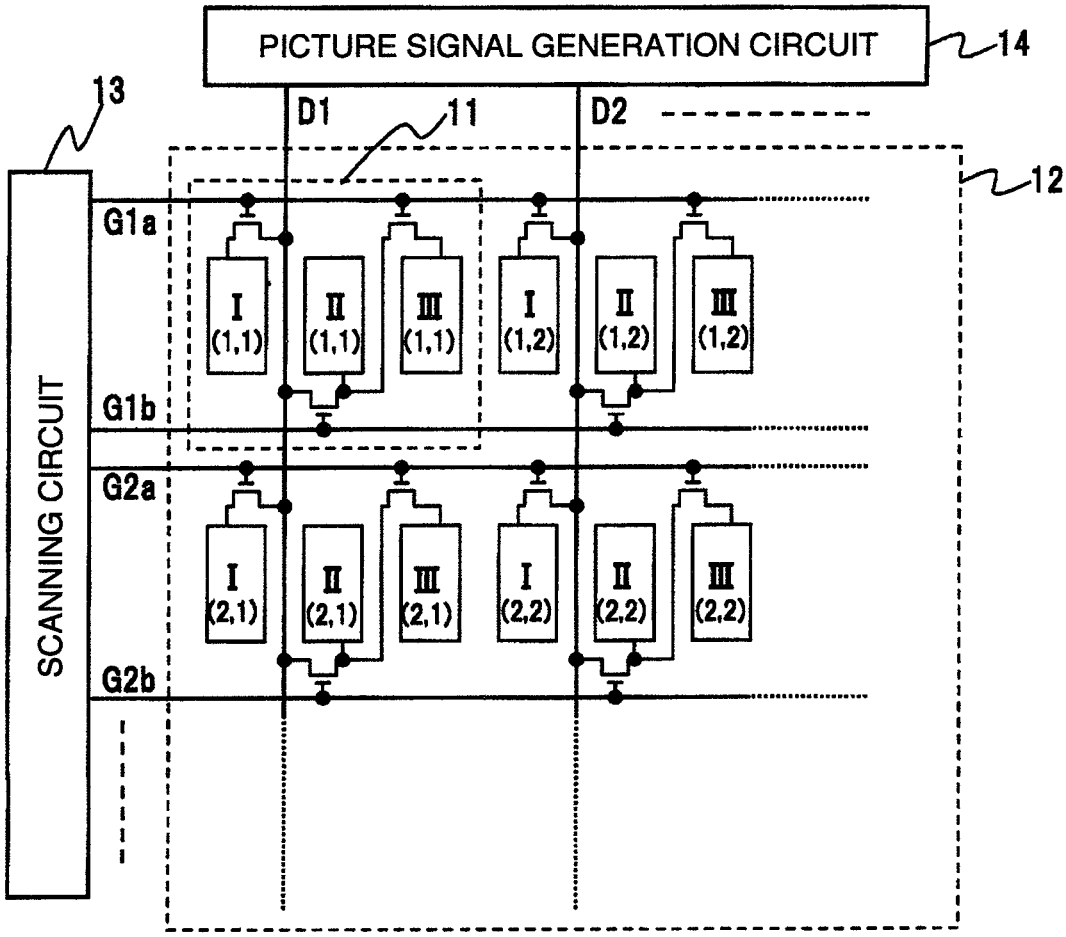
FIG. 1 shows the layout of pixels in a display device as a first embodiment of this invention.
Figure 2:
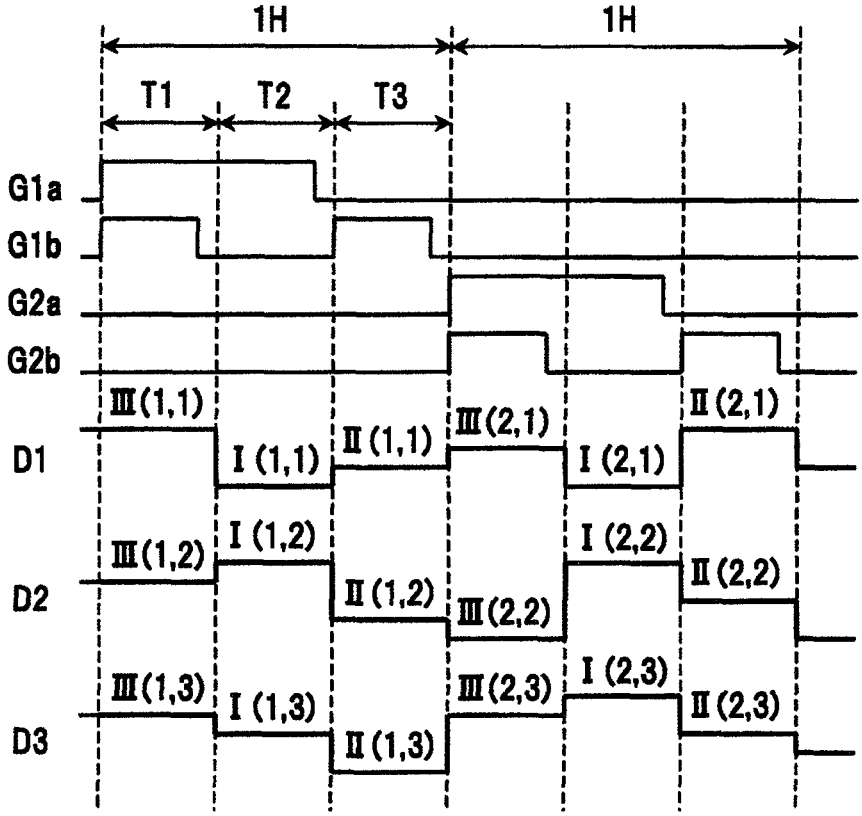
FIG. 2 is a diagram showing the waveforms varying with time of signals for driving pixels shown in FIG. 1.

FIG. 1 shows the layout of pixels in a display device as a first embodiment of this invention and FIG. 2 is a diagram showing the waveforms varying with time of signals for driving pixels shown in FIG. 1. As shown in FIGS. 1 and 2, according to this embodiment, signal voltages are distributed to three pixels by using two gate lines and one signal line.

In FIG. 1, gate lines are indicated by G1*a*, G1*b*, G2*a*, G2*b*, . . . , etc. while signal lines crossing these gate lines are denoted by D1, D2, . . . , etc. Transparent pixel electrodes I, II and III are disposed in the area of intersection between a gate line G and a signal line D. These transparent pixel electrodes I, II and III constitute a pixel 11 as a basic picture element. These pixels 11 as basic picture elements are laid out on a thin film transistor (TFT) substrate 12 in the form of matrix. The parentheses ( ) shown in the transparent pixel electrodes I, II and III give the (row, column) representation for pixels arranged in the form of matrix.

The transparent pixel electrodes I, II and III are connected with their driving TFTs. The gate electrodes of the TFTs connected with the transparent pixel electrodes I and III are connected with the preceding gate line while the gate electrode of the TFT connected with the transparent pixel electrode II is connected with the following gate line. Here, the terms "preceding" and "following" relate to the successive turns in the order in time of scanning. The drain (or source) electrode of the TFT connected with the transparent pixel electrodes II is connected through wiring conductor with the source (or drain) electrode of the TFT connected with the transparent pixel electrode III. Color filter substrates which sandwiches a liquid crystal layer on the TFT substrate 12 are not shown in the figure, but they are disposed in parallel to the TFT substrate 12.

A scanning circuit 13 successively selects the gate lines G1, G2, . . . , etc. In accordance with the selected gate lines G, three signal voltages, e.g. R, G and B signal voltages, are delivered to the relevant signal lines D from a picture signal generation circuit 14.

In FIG. 2, waveforms labeled G1*a*, G1*b*, G2*a* and G2*b* correspond to the gate voltages at the gate lines G1 and G2. When these waveforms are at high level, the associated TFTs are conductive, i.e. in the "turned-on" state, while when they are at low level, the associated TFTs are cut off, i.e. in the "turned-off" state. One horizontal scanning period (1H) is time-sequentially divided into three sub-periods T1, T2 and T3. During the respective sub-periods, signal voltages are written in the capacitances associated with the transparent pixel electrodes I, II and III. It is at the fall instants of the signals on the gate lines G that the capacitances associated with the transparent pixel electrodes I, II and III are completely charged with the signal voltage on the signal line D.

First, when the gate lines G1*a* and G1*b* are both driven to "high" level during the sub-period T1, the TFTs connected with the transparent pixel electrodes I, II and III in the first row are turned on. As a result, the signal voltage for the transparent pixel electrode III is written in the capacitances associated with the transparent pixel electrodes I, II and III from the signal lines D1, D2, D3, . . . , etc.

Then, during the sub-period T2, if the gate line G1*a* remains at "high" level whereas the gate line G1*b* is driven to "low" level, the TFTs connected with the transparent pixel electrodes II and III are turned off whereas the TFT connected with the transparent pixel electrode I is turned on. Consequently, the signal voltage for the transparent pixel electrode III written in the transparent pixel electrode I is replaced by the signal voltage for the transparent pixel electrode I.

Further, during the sub-period T3, if the gate line G1*a* is driven to "low" level and the gate line G1*b* to "high" level, then the TFTs connected with the transparent pixel electrodes I and III are turned off whereas the TFT connected with the transparent pixel electrode II is turned on. Thus, the signal voltage for the transparent pixel electrode III written in the transparent pixel electrode II is replaced by the signal voltage for the transparent pixel electrode II.

In this way, the properly corresponding signal voltages are time-sequentially, i.e. in a time-divisional manner, written respectively in the transparent pixel electrodes I, II and III in the first row.

During the next horizontal period (1H), the same operations are repeated to time-sequentially write the properly corresponding signal voltages in the transparent pixel electrodes I, II and III in the second row.

[Embodiment 2]

Figure 3:
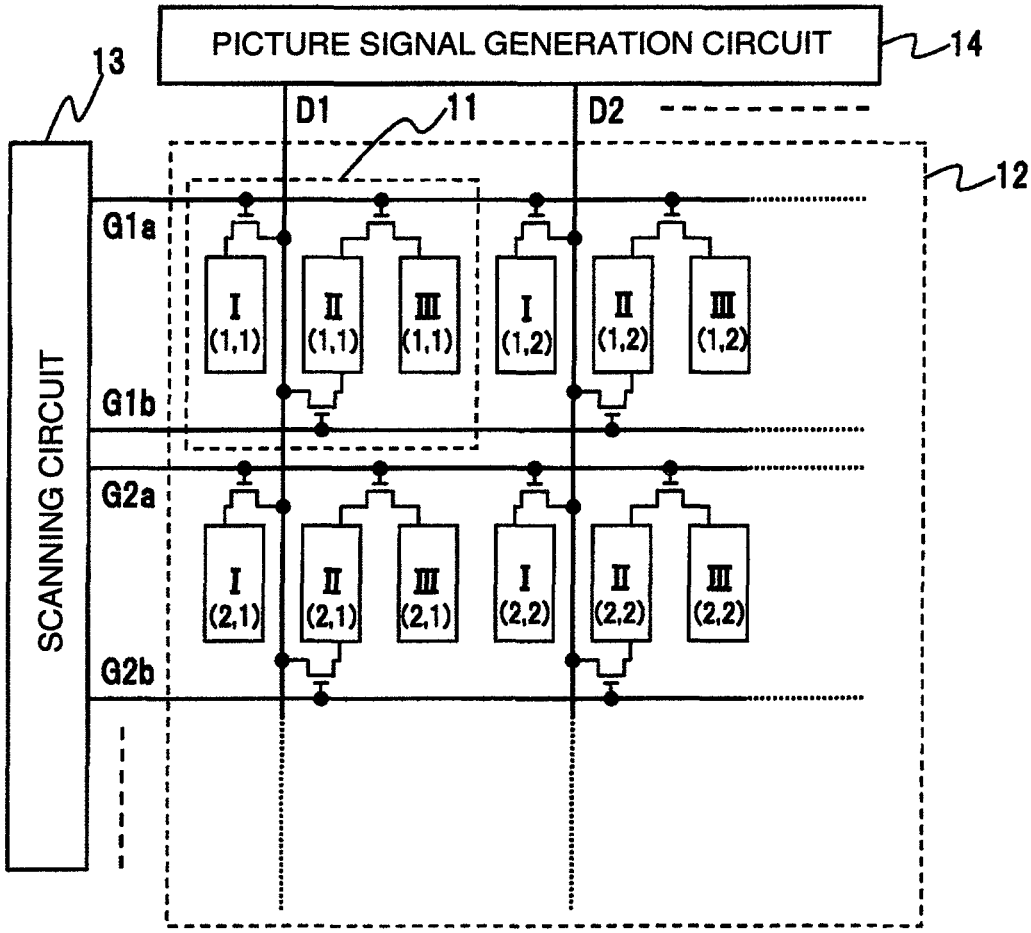
FIG. 3 shows the layout of pixels in a display device as a second embodiment of this invention.

The second embodiment of this invention will be described with reference to FIGS. 3 and 4. The second embodiment shown in FIG. 3 is different from the first embodiment shown in FIG. 1 in that the conductor line connecting the drain (source) of the TFT coupled to the transparent pixel electrode II with the source (drain) of the TFT coupled to the transparent pixel electrode III as shown in FIG. 1 is replaced by the transparent pixel electrode II as shown in FIG. 3. This modification can prevent the aperture from deteriorating.

Figure 4:
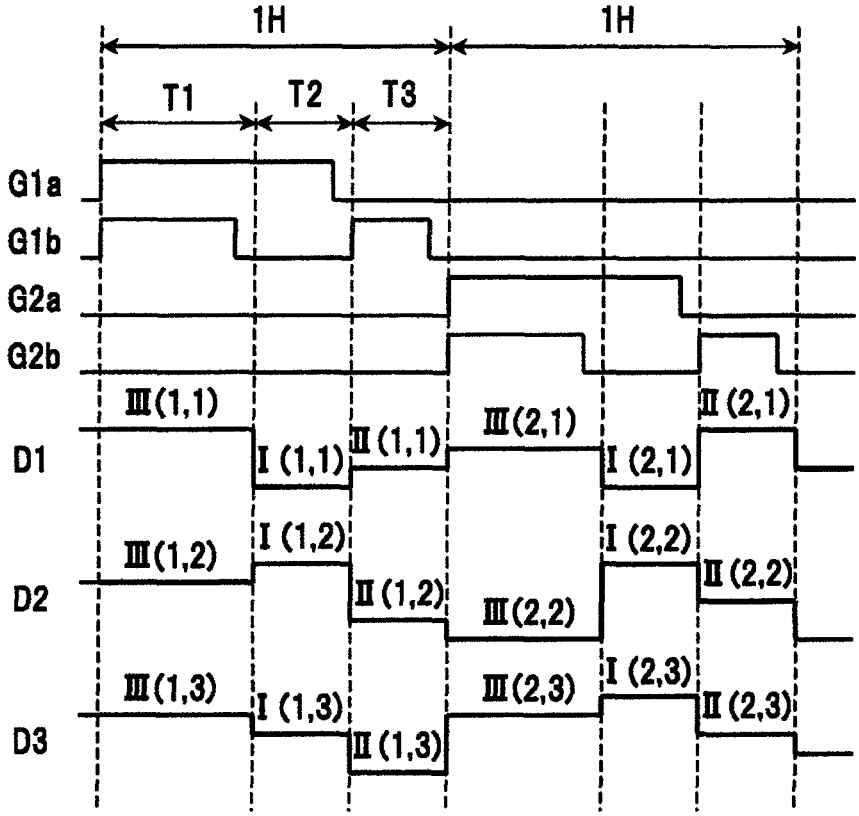
FIG. 4 is a diagram showing the waveforms varying with time of signals for driving pixels shown in FIG. 3.

Further, although in the first embodiment shown in FIG. 1 the horizontal period (1H) is divided into the three equal sub-periods T1, T2 and T3, the horizontal period is divided, in this second embodiment, into three sub-periods T1, T2 and T3 such that T1>T2=T3, as shown in FIG. 4. This adjustment of the sub-periods is necessitated due to the fact that since the conductor line in the first embodiment is replaced in this embodiment by the transparent pixel electrode II whose electric resistance is larger than that of the conductor line, the time required for the signal voltage to be written in the transparent pixel electrode III must be set longer. The rest of constitution is the same as in the first embodiment.

[Embodiment 3]

Figure 5:
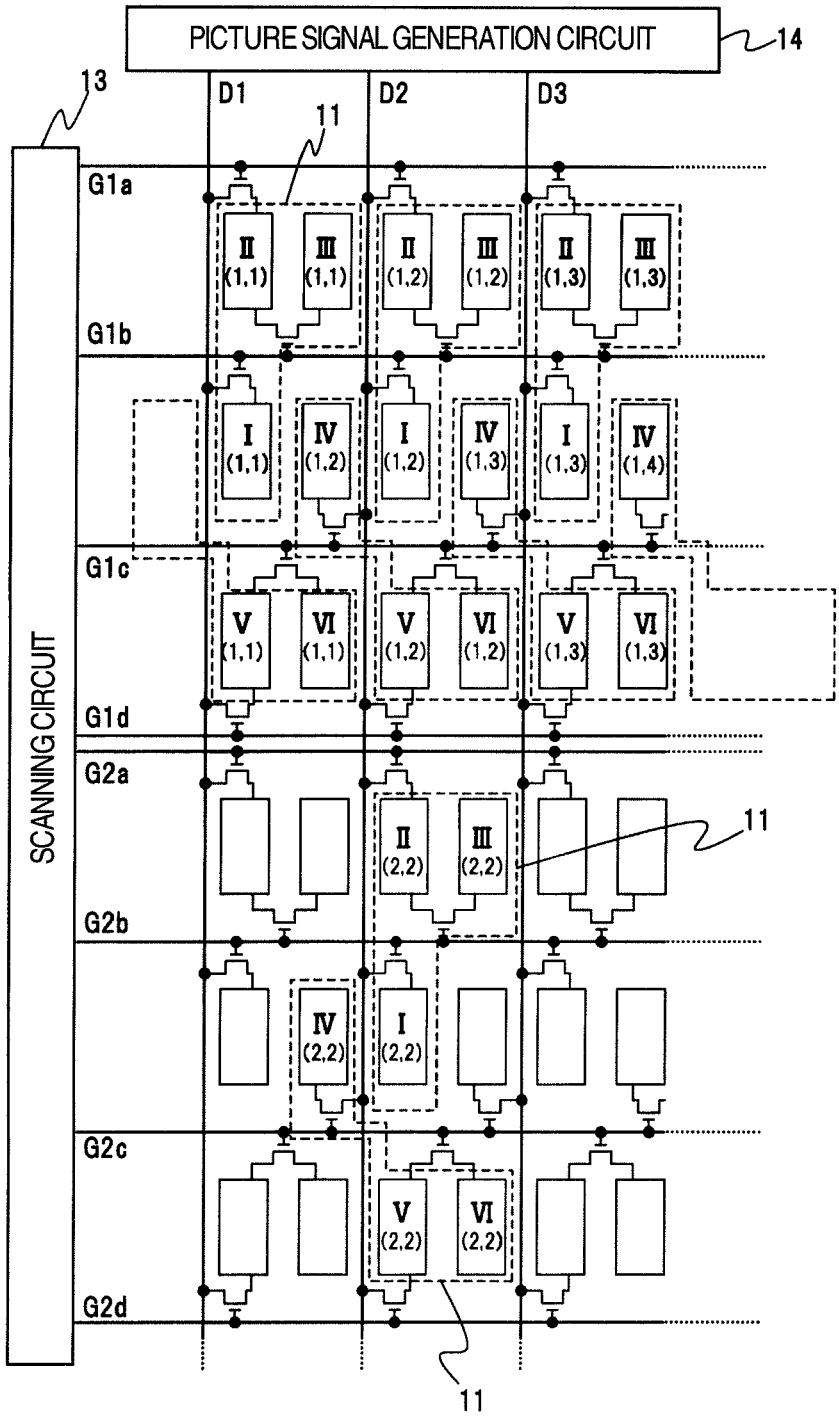
FIG. 5 shows the layout of pixels in a display device as a third embodiment of this invention.

The third embodiment of this invention will be described with reference to FIGS. 5 and 6. As shown in FIG. 5, the structure of the pixels is a modification of the pixel structure shown as the second embodiment in FIG. 3. The basic structure consists of transparent pixel electrodes I, II and III controlled by gate lines G1*a* and G1*b* and transparent pixel electrodes IV, V and VI controlled by gate lines G1*c* and G1*d*.

Figure 6:
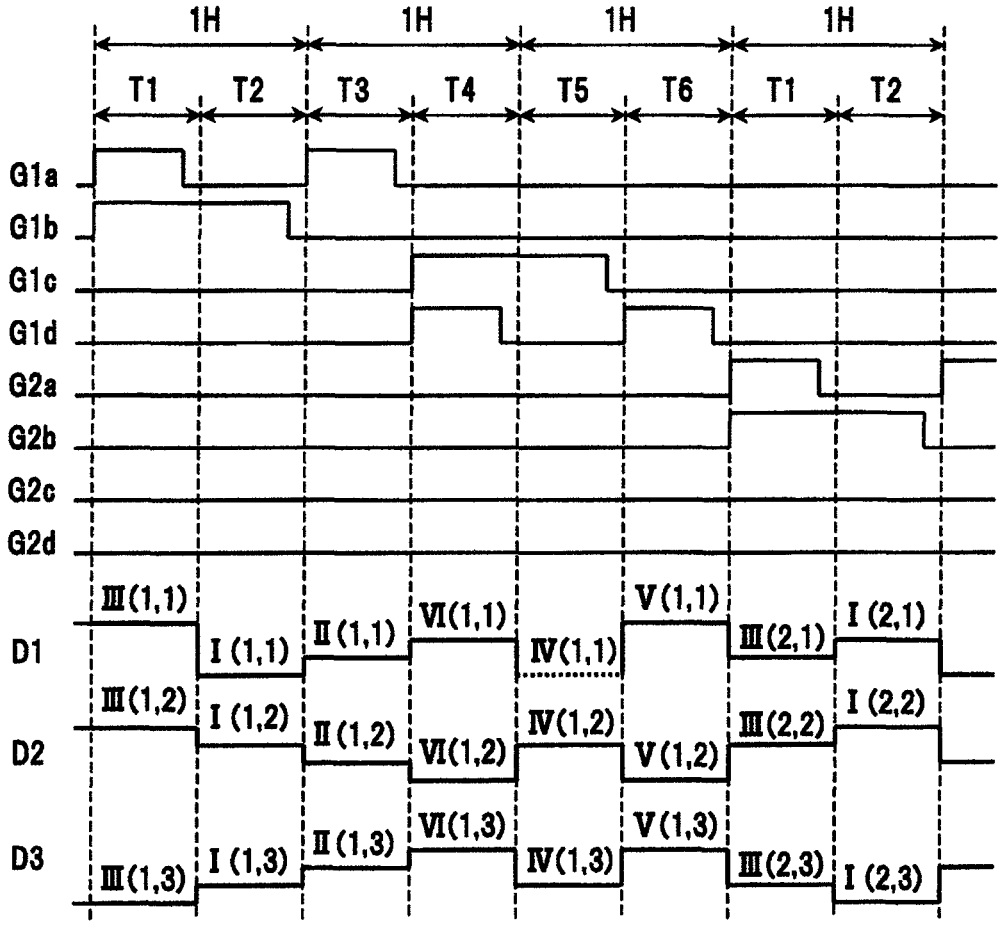
FIG. 6 is a diagram showing the waveforms varying with time of signals for driving pixels shown in FIG. 5.

In this third embodiment, as shown in FIG. 6, the three lines can be controlled by the four gate lines G over the three horizontal periods. This constitution can effectively halve the number of used signal lines D, leading to the reduction of the number of wiring conductors.

First, when the gate lines G1*a* and G1*b* are both driven to "high" level during the first sub-period T1 of the first horizontal period, the TFTs connected with the transparent pixel electrodes I, II and III are turned on. As a result, the signal voltage for the transparent pixel electrode III is written in the capacitances associated with the transparent pixel electrodes I, II and III from the signal lines D1, D2, D3, . . . , etc.

Then, during the second sub-period T2 of the first horizontal period, if the gate line G1*a* is driven to "low" level whereas the gate line G1*b* remains at "high" level, the TFTs connected with the transparent pixel electrodes II and III are turned off whereas the TFT connected with the transparent pixel electrode I is turned on. Consequently, the signal voltage for the transparent pixel electrode III written in the transparent pixel electrode I is replaced by the signal voltage for the transparent pixel electrode I.

Further, during the first sub-period T3 belonging to the second horizontal period, if the gate line G1*a* is driven to "high" level and the gate line G1*b* to "low" level, then the TFTs connected with the transparent pixel electrodes I and III are turned off whereas the TFT connected with the transparent pixel electrode II is turned on. Thus, the signal voltage for the transparent pixel electrode III written in the transparent pixel electrode II is replaced by the signal voltage for the transparent pixel electrode II.

Still further, when the gate lines G1*c* and G1*d* are both driven to "high" level during the second sub-period T4 of the second horizontal period, the TFTs connected with the transparent pixel electrodes IV, V and VI are turned on. As a result, the signal voltage for the transparent pixel electrode VI is written in the capacitances associated with the transparent pixel electrodes IV, V and VI from the signal lines D1, D2, D3, . . . , etc.

Yet further, during the first sub-period T5 of the third horizontal period, if the gate line G1*c* remains at "high" level whereas the gate line G1*d* is driven to "low" level, the TFTs connected with the transparent pixel electrodes V and VI are turned off whereas the TFT connected with the transparent pixel electrode IV is turned on. Consequently, the signal voltage for the transparent pixel electrode VI written in the transparent pixel electrode IV is replaced by the signal voltage for the transparent pixel electrode IV. It is to be noted here that since during this sub-period T5 the transparent pixel electrode IV(1, 1) is not available, this signal voltage is represented by a broken line segment in the waveform diagram in FIG. 5.

Finally, during the second sub-period T6 of the third horizontal period, if the gate line G1*c* is driven to "low" level whereas the gate line G1*d* is driven to "high" level, then the TFTs connected with the transparent pixel electrodes IV and VI are turned off whereas the TFT connected with the transparent pixel electrode V is turned on. Consequently, the signal voltage for the transparent pixel electrode IV written in the transparent pixel electrode V is replaced by the signal voltage for the transparent pixel electrode V.

In this way, the properly corresponding signal voltages are time-sequentially written respectively in the transparent pixel electrodes I, II, III, IV, V and VI.

During the three following horizontal periods, the same operations are repeated to time-sequentially write the properly corresponding signal voltages in the transparent pixel electrodes I, II, III, IV, V and VI.

[Embodiment 4]

Figure 7:
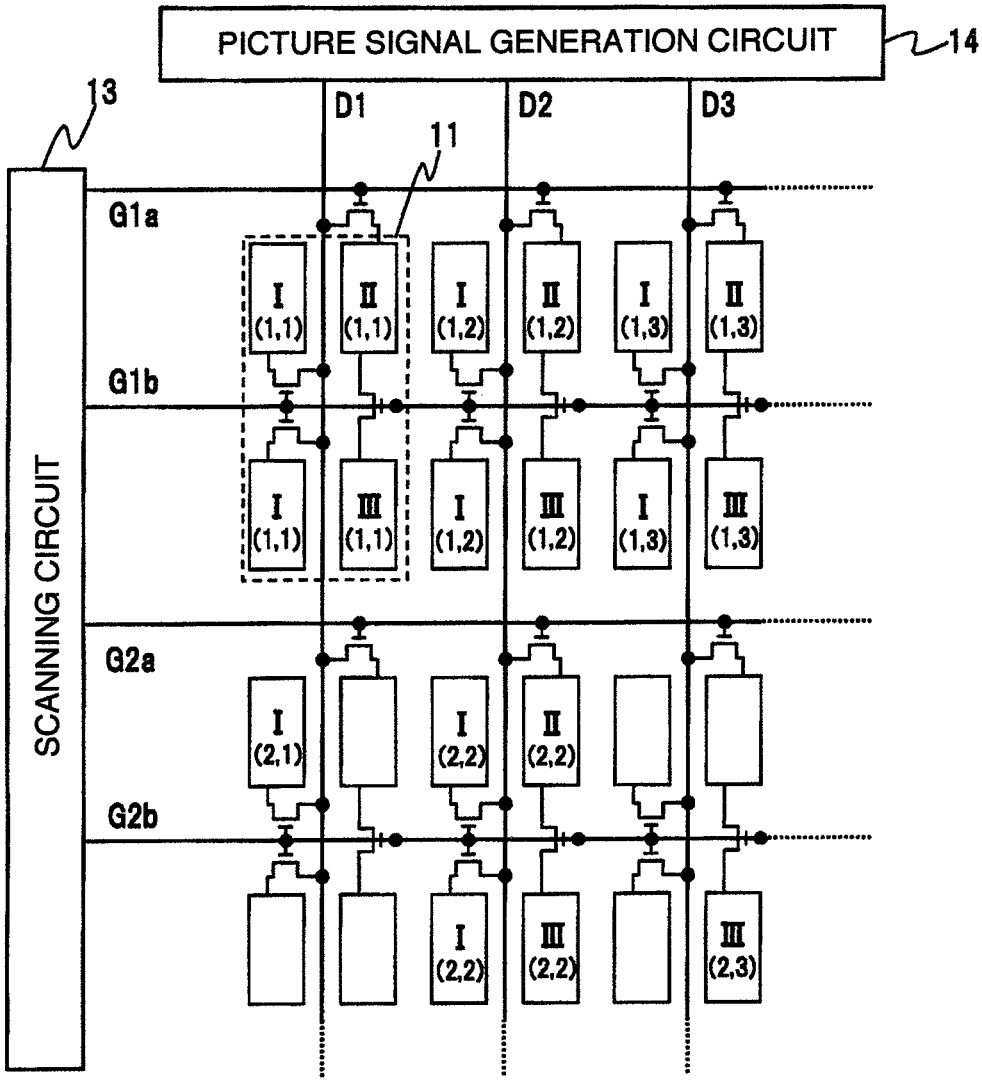
FIG. 7 shows the layout of pixels in a display device as a fourth embodiment of this invention.
Figure 8:
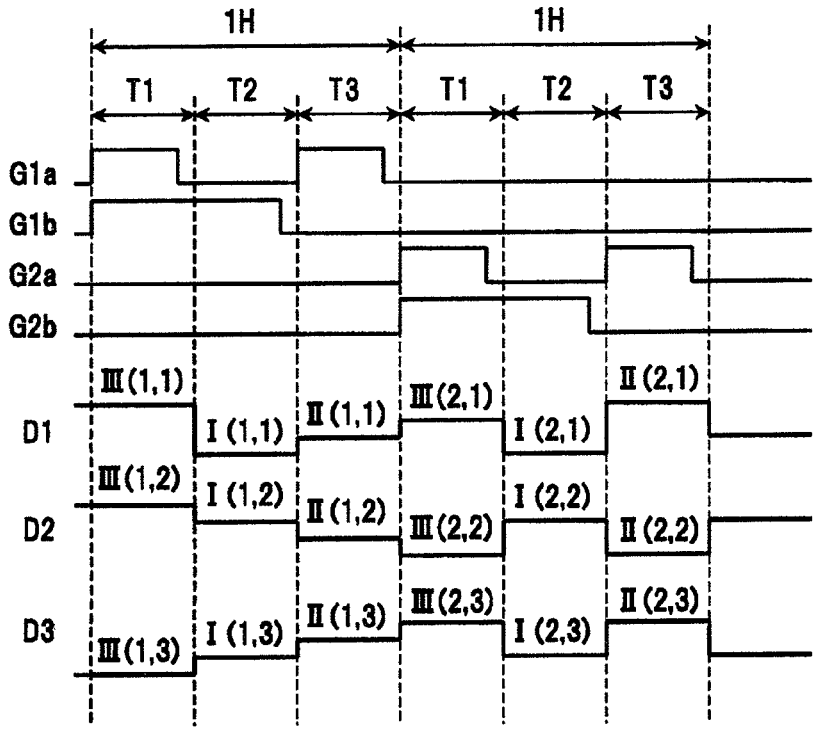
FIG. 8 a diagram showing the waveforms varying with time of signals for driving pixels shown in FIG. 7.

The fourth embodiment of this invention will be described with reference to FIGS. 7 and 8. As shown in FIG. 7, the structure of the pixels is a modification of the pixel structure shown as the second embodiment in FIG. 3. The basic pixel structure 11 consists of four transparent pixel electrodes: two transparent pixel electrodes I, a transparent pixel electrode II and a transparent electrode III.

How the basic pixel structure 11 shown in FIG. 7 is driven will be described with reference to FIG. 8. First, when the gate lines G1*a* and G1*b* are both driven to "high" level during the sub-period T1, the TFTs connected with the transparent pixel electrodes I, II and III in the first row are turned on. As a result, the signal voltage for the transparent pixel electrode III is written in the capacitances associated with the transparent pixel electrodes I, II and III from the signal lines D1, D2, D3, . . . , etc.

Then, during the sub-period T2, if the gate line G1*a* is driven to "low" level whereas the gate line G1*b* remains at "high" level, the TFTs connected with the transparent pixel electrodes II and III are turned off whereas the TFTs connected with the two transparent pixel electrodes I are turned on. Consequently, the signal voltage for the transparent pixel electrode III written in the two transparent pixel electrodes I are replaced by the signal voltage for the transparent pixel electrode I.

Further, during the sub-period T3, if the gate line G1*a* is driven to "high" level and the gate line G1*b* to "low" level, then the TFTs connected with the two transparent pixel electrodes I and the transparent pixel electrode III are turned off whereas the TFT connected with the transparent pixel electrode II is turned on. Thus, the signal voltage for the transparent pixel electrode III written in the transparent pixel electrode II is replaced by the signal voltage for the transparent pixel electrode II.

In this way, the properly corresponding signal voltages are time-sequentially written respectively in the two transparent pixel electrodes I, the transparent pixel electrode II and the transparent pixel electrode III in the first row.

During the next horizontal period (1H), the same operations are repeated to time-sequentially write the properly corresponding signal voltages in the two transparent pixel electrodes I, the transparent pixel electrode II and the transparent pixel electrode III in the second row.

Figure 9A:
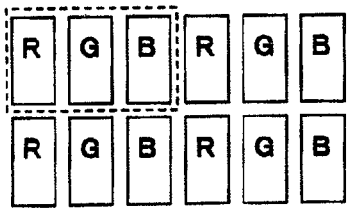
FIGS. 9A, 9B and 9C show the different layouts of color filter elements.
Figure 9B:
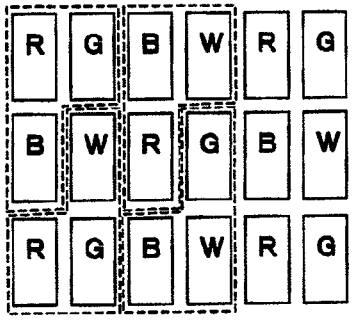
Figure 9C:
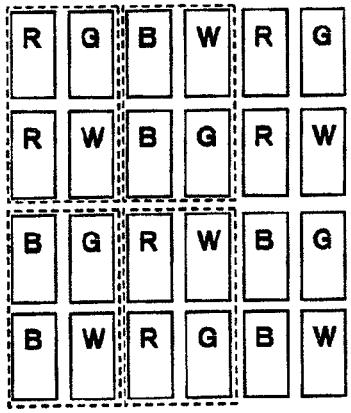

FIGS. 9A, 9B and 9C show the different layouts of color filter elements on a color filter substrate. As shown in FIG. 9A, color filters for red (R), green (G) and blue (B) are overlaid with the transparent pixel electrodes I, II and III in the first and second embodiments shown in FIGS. 1 and 3, respectively.

As shown in FIG. 9B, color filters B, R and G are disposed corresponding to the transparent pixel electrodes I, II and III in the first row and the first column in the third embodiment shown in FIG. 5. For the transparent pixel electrodes I, II and III in the first row and the second column, color filters R, B and W (white) are disposed respectively. And this layout is repeated up to the first row and the last column in the horizontal direction. On the other hand, color filters G, R and G are disposed corresponding to the transparent pixel electrodes IV, V and VI in the first row and the first column in the third embodiment shown in FIG. 5. For the transparent pixel electrodes IV, V and VI in the first row and the second column, color filters W, B and W are disposed respectively. And this layout is repeated up to the first row and the last column in the horizontal direction. Signal voltages R, G, B and W are supplied through the signal lines D to the color filters R, G, B and W overlaid with the transparent pixel electrodes I, II, III, IV, V and VI.

As shown in FIG. 9C, color filters R, R, G and W are disposed corresponding to the transparent pixel electrodes I, I, II and III in the first row and the first column in the fourth embodiment shown in FIG. 7. For the transparent pixel electrodes I, I, II and III in the first row and the second column, color filters B, B, W and G are disposed respectively. And this layout is repeated up to the first row and the last column in the horizontal direction. Then, color filters B, B, G and W are disposed corresponding to the transparent pixel electrodes I, I, II and III in the second row and the first column. Further, for the transparent pixel electrodes I, I, II and III in the second row and the second column, color filters R, R, W and G are disposed respectively. And this layout is repeated up to the second row and the last column in the horizontal direction. Signal voltages R, G, B and W are supplied through the signal lines D to the color filters R, G, B and W overlaid with the transparent pixel electrodes I, I, II and III.

[Embodiment 5]

Figure 10:
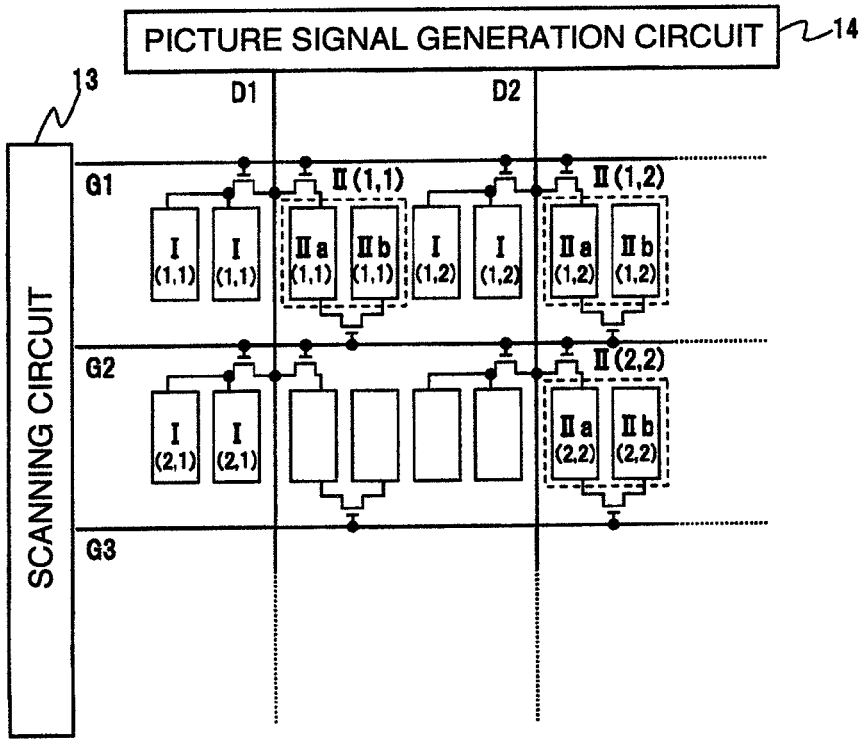
FIG. 10 shows the layout of pixels in a display device as a fifth embodiment of this invention.

The fifth embodiment of this invention will be described with reference to FIGS. 10 and 11. As shown in FIG. 10, the basic picture element, i.e. pixel, consists of transparent pixel electrodes I, I, and II, and the transparent pixel electrode II is divided into two electrodes IIa and IIb. The transparent pixel electrodes constituting a pixel are controlled by the two adjacent gate lines G and supplied with signal voltage from the single signal line D.

Figure 11:
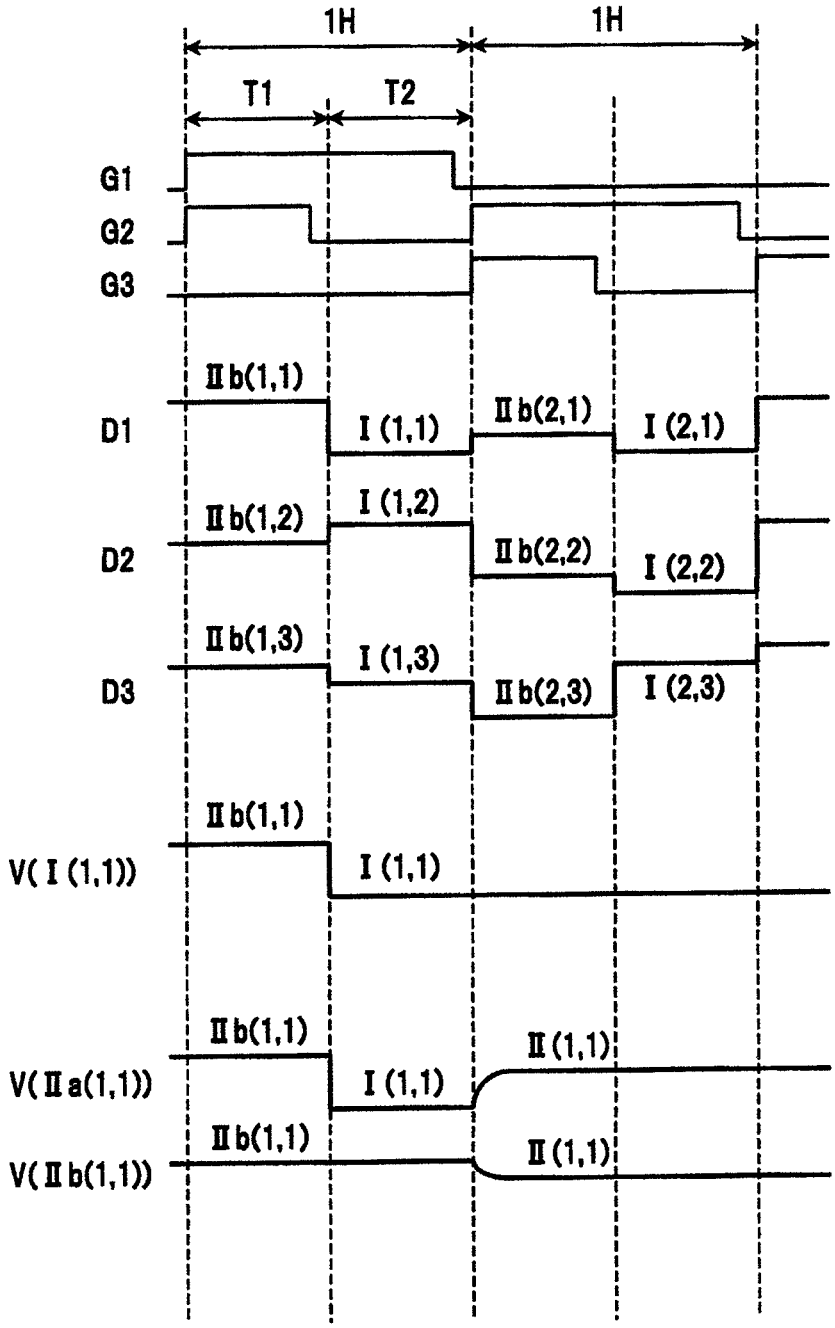
FIG. 11 is a diagram showing the waveforms varying with time of signals for driving pixels shown in FIG. 11.

As shown in the waveform diagram in FIG. 11, the signal voltage at the transparent pixel electrodes I, I is determined toward the end of the sub-period T2 of the first horizontal period (or the fall instant of the signal on the gate line G1) whereas the signal voltage at the transparent pixel electrode II is determined as a result of averaging the electric charges at the transparent pixel electrodes IIa and IIb. Namely, the signal voltage V(I(1,1)) of the transparent pixel electrodes I, I is determined during the sub-period T2 while the signal voltages V(IIa(1,1)) and V(IIb(1, 1)) of the transparent pixel electrodes IIa and IIb are averaged after the end of the sub-period T2 of the first horizontal period (1H) so that they take on a value V(II(1,1)) that is the averaged signal voltage used as the signal voltage for the transparent pixel electrode II.

Now, let it be assumed that the total of the electric capacitance of the transparent pixel electrode IIa and its parasitic capacitance is denoted by Ca and that the total of the electric capacitance of the transparent pixel electrode IIb and its parasitic capacitance is denoted by Cb. Then, the signal voltage V(IIb(1,1)) is written in the transparent pixel electrode IIb during the sub-period T1 whereas the signal voltage at the transparent pixel electrode IIa is replaced by the signal voltage V(I(1, 1)) of the transparent pixel electrode I during the sub-period T2. Accordingly, the electric charges accumulated during the sub-periods T1 and T2 are averaged to develop a voltage represented by the following expression.

$$V(II(1,1))=(Ca\times V(I(1,1))+Cb\times V(IIb(1,1)))/(Ca+Cb),$$

where V(II(1,1)) is the signal voltage at the transparent pixel electrode II after averaging. The signal voltage V(IIb(1,1)) is calculated from the target signal voltage V(II(1,1)) and the signal voltage V(I(1,1)) by using this expression. By applying the calculated signal voltage V(IIb(1,1)) to the signal line D, the target signal voltage V(I(1,1)) and the signal voltage V(II(1,1)) can be applied respectively to the transparent pixel electrodes I and II.

According to this embodiment, a signal voltage can be supplied from a single signal line D to two pixels without increasing the number of gate lines G. Further, since the transparent pixel electrode IIa is used for signal transfer, the aperture can be prevented from deteriorating.

[Embodiment 6]

Figure 12:
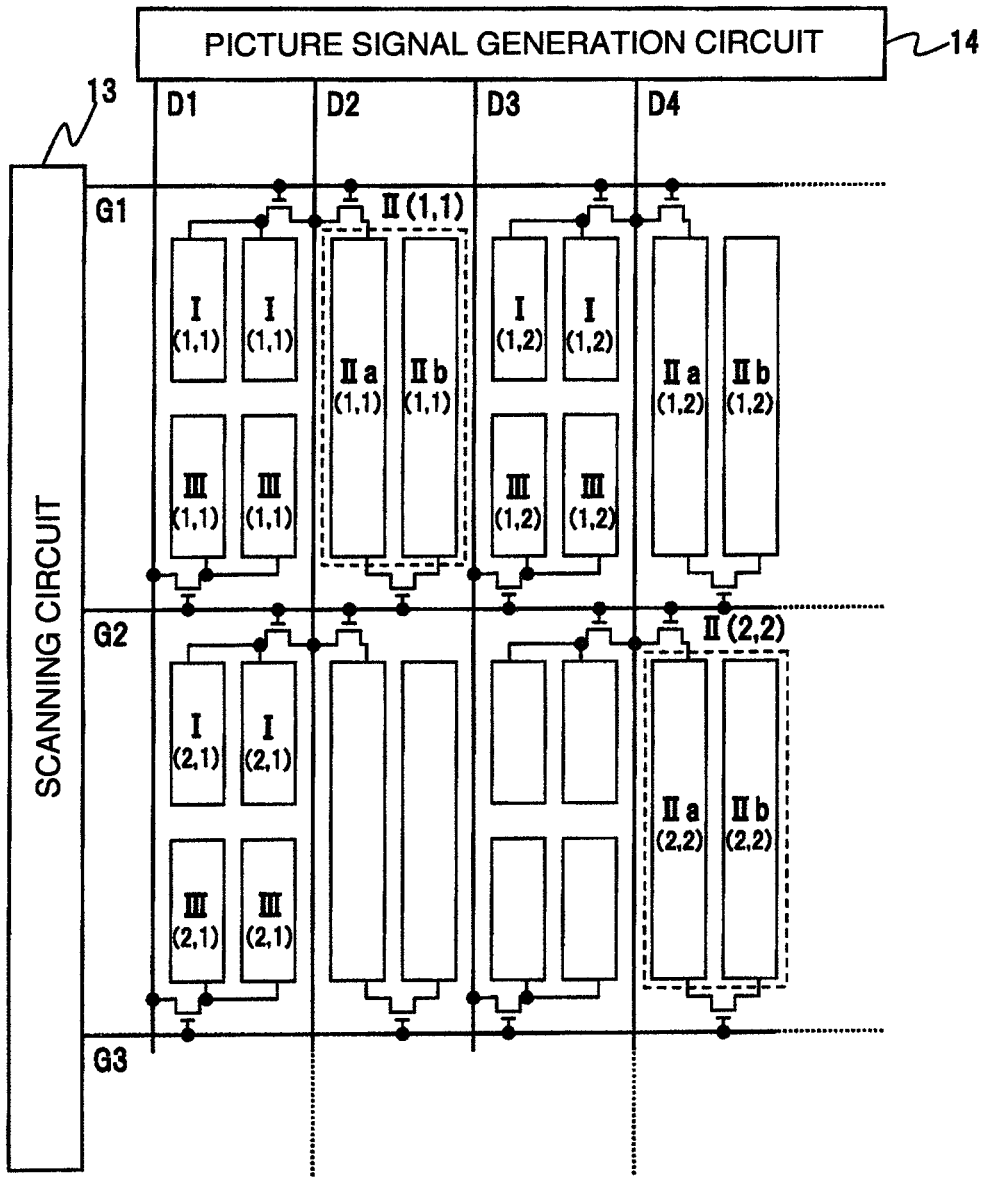
FIG. 12 shows the layout of pixels in a display device as a sixth embodiment of this invention.
Figure 13:
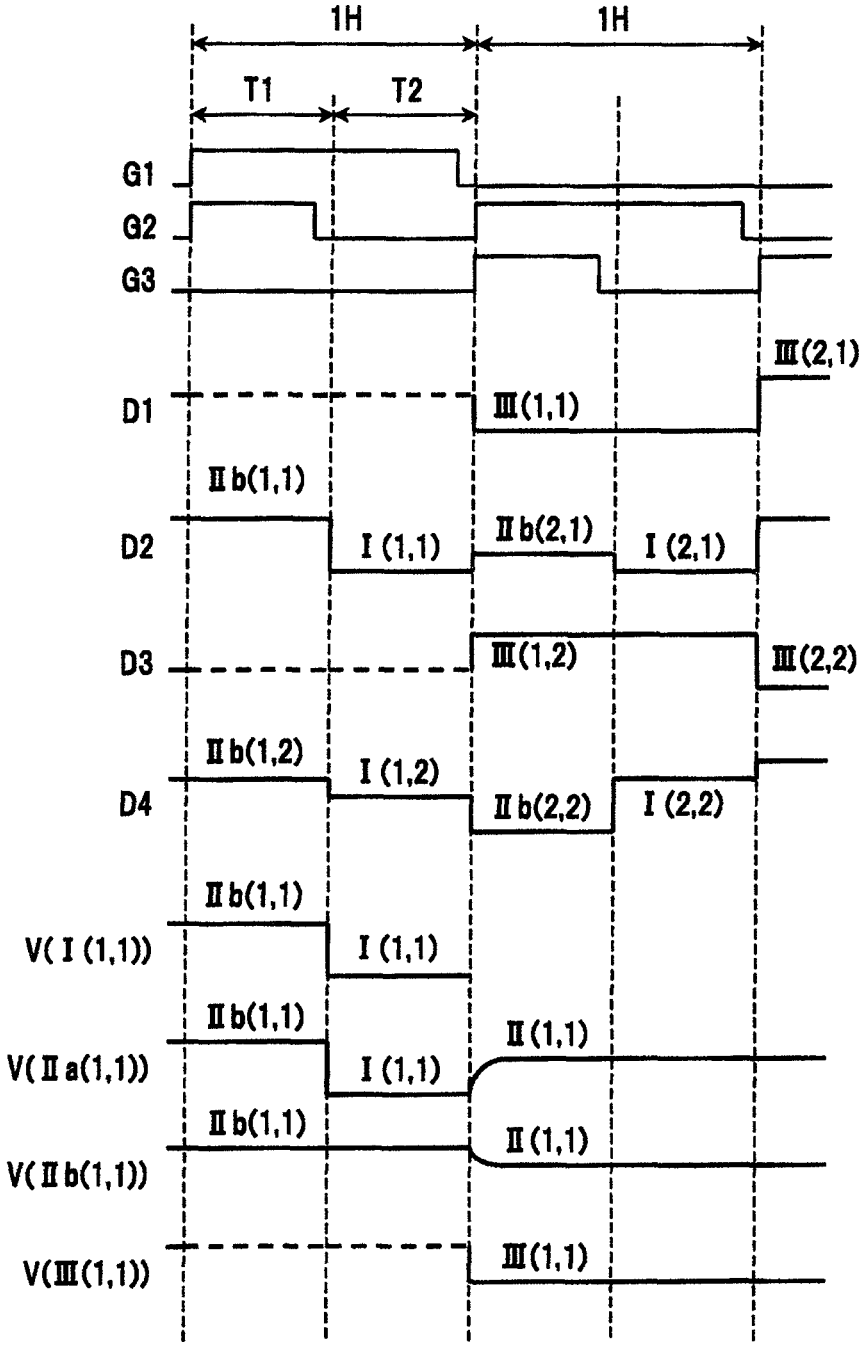
FIG. 13 is a diagram showing the waveforms varying with time of signals for driving pixels shown in FIG. 12.

The sixth embodiment of this invention will now be described with reference to FIGS. 12 and 13. As shown in FIG. 12, the pixel structure according to this embodiment is the combination of the pixel structure shown as the fifth embodiment in FIG. 10 and two added transparent pixel electrodes III, III. In FIG. 12, the transparent pixel electrodes III, III are supplied with signal voltages from the odd-numbered signal lines D1, D3, . . . , etc. The waveform diagram of FIG. 13 is different from the waveform diagram of FIG. 11 showing the fifth embodiment, in that the signal voltages V(III) for the added transparent pixel electrodes III, III are supplied from the odd-numbered signal lines D1, D3, . . . , etc. On the other hand, the waveform diagram of FIG. 13 is the same as the waveform diagram of FIG. 11 showing the fifth embodiment, in that the signal voltages V(I) and V(II) for the transparent pixel electrodes I, I and II are supplied from the even-numbered signal lines D2, D4, . . . , etc.

As shown in FIG. 13, the transparent pixel electrodes III (1,1) and III(1,2) connected respectively with the signal lines D1 and D3 are in the "on" state during the sub-period T1 of the first horizontal period and also in the "on" state during the sub-period T1 of the second horizontal period. Accordingly, the signal voltages V(III(1,1)) and V(III(1,2)) for the transparent pixel electrodes III(1,1) and III(1,2) are determined during the sub-period T1 of the second horizontal period.

Figure 14:
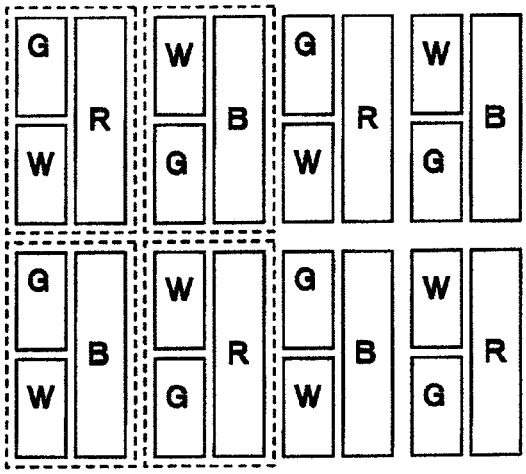
FIG. 14 shows the layout of color filter elements used in the embodiment shown in FIG. 12.

FIG. 14 shows the layout of color filter elements on the color filter substrate, used in this embodiment. As shown in FIG. 14, color filters for G, W and R are disposed corresponding to the transparent pixel electrodes I, II and III in the first row and the first column. Then, color filters W, G and B are disposed corresponding to the transparent pixel electrodes I, II and III in the first row and the second column. And this layout is repeated up to the first row and the last column in the horizontal direction. In like manner, color filters G, W and B are disposed corresponding to the transparent pixel electrodes I, II and III in the second row and the first column. Further, for the transparent pixel electrodes I, II and III in the second row and the second column, color filters W, G and R are disposed respectively. And this layout is repeated up to the second row and the last column in the horizontal direction. Signal voltages R, G, B and W are time-sequentially supplied through the signal lines D to the color filters R, G, B and W overlaid with the transparent pixel electrodes I, II and III.

[Embodiment 7]

Figure 15:
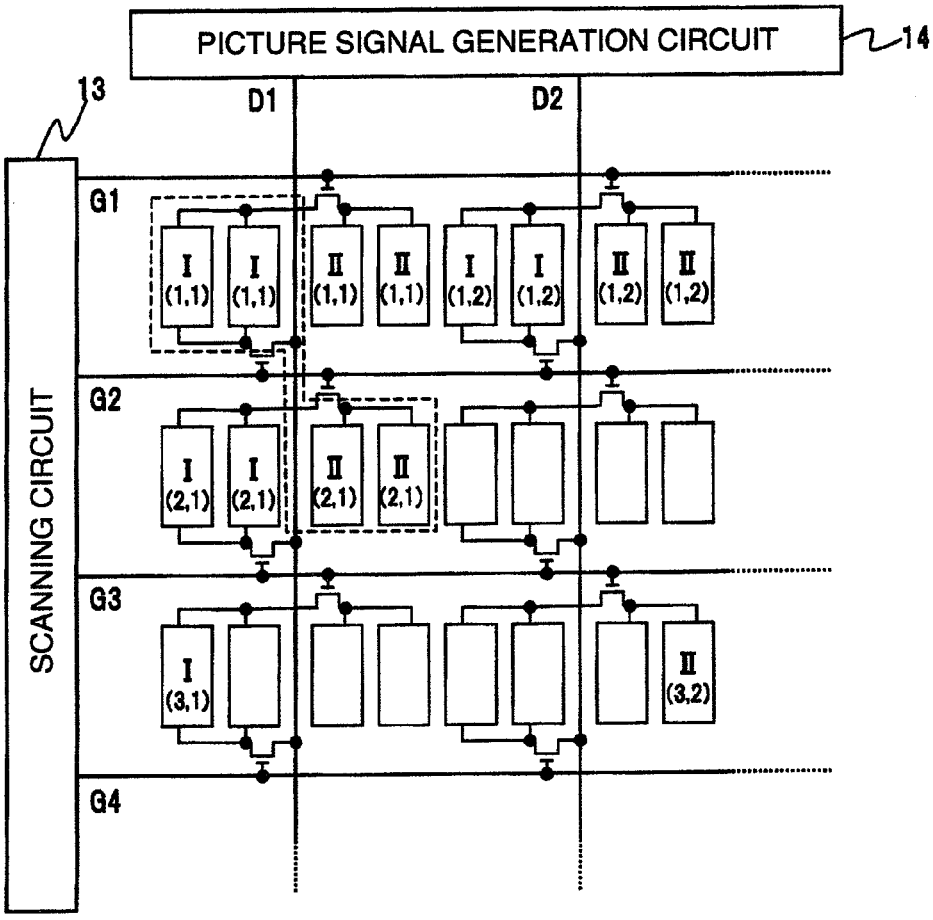
FIG. 15 shows the layout of pixels in a display device as a seventh embodiment of this invention.

The seventh embodiment of this invention will now be described with reference to FIGS. 15 and 16. As shown in FIG. 15, according to this embodiment, the transparent pixel electrode I is used for the transfer of electric charges from the signal line D, and the two transparent pixel electrodes I and II are controlled by the two adjacent gate lines G, so that a signal voltage is supplied to the two transparent pixel electrodes I and II through the single signal line D. Each of the transparent pixel electrodes I and II is made up of two equivalent transparent pixel electrodes. Specifically, in the transparent pixel electrode I, the pair of the transparent pixel electrodes are electrically connected in parallel with each other so that the electric resistance of the transparent pixel electrode I can be reduced in the transfer of electric charges through the electrode I.

Figure 16:
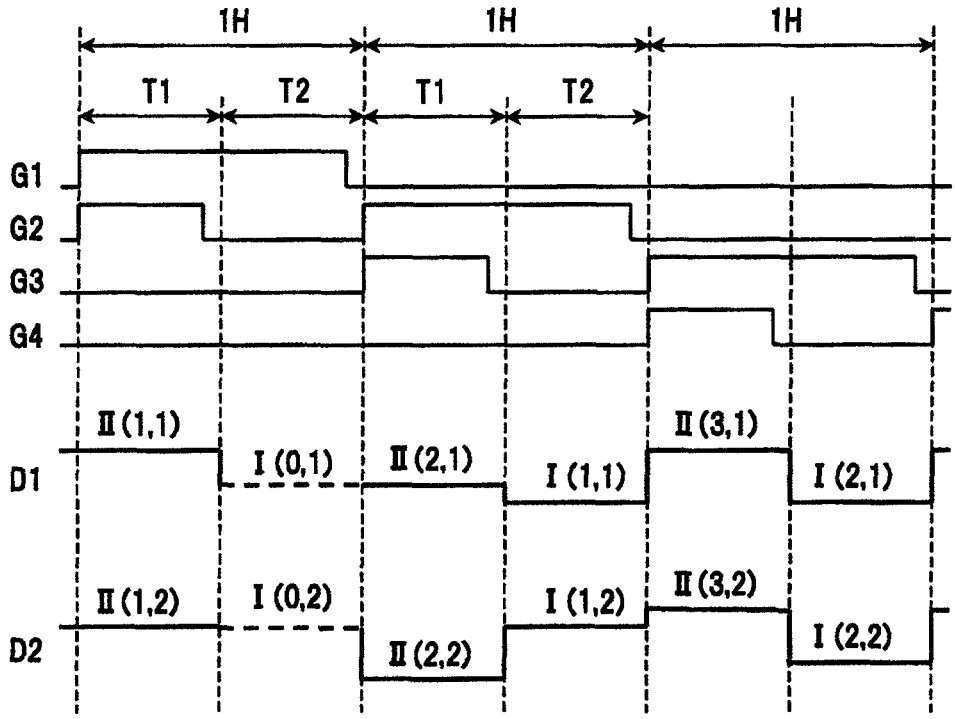
FIG. 16 is a diagram showing the waveforms varying with time of signals for driving pixels shown in FIG. 15.

In FIG. 16, the TFTs connected with the transparent pixel electrodes I and II in the first row are turned on by driving both the gate lines G1 and G2 to "high" level during the sub-period T1 of the first horizontal period (1H), so that the signal voltage for the transparent pixel electrode II is written in the capacitances of the transparent pixel electrodes I and II in the first row from the signal lines D1, D2, . . . , etc.

Then, during the sub-period T2, the TFTs connected with the transparent pixel electrodes I and II are turned off by keeping the gate line G1 at "high" level and driving the gate line G2 to "low" level. During the sub-period T2, signal voltages are to be supplied to non-existent transparent pixel electrodes I(0,1) and I(0,2) from the signal lines D1 and D2 and therefore such signal voltages are represented by broken line segments in FIG. 16.

The TFTs connected with the transparent pixel electrodes I and II in the second row are turned on by driving both the gate lines G2 and G3 to "high" level during the sub-period T1 of the second horizontal period (1H), so that the signal voltage for the transparent pixel electrode II is written in the capacitances of the transparent pixel electrodes I and II in the second row from the signal lines D1,D2, etc.

Then, during the sub-period T2, by keeping the gate line G2 at "high" level and driving the gate line G3 to "low" level, the TFTs connected with the transparent pixel electrodes II in the second row are turned off while the TFTs connected with the transparent pixel electrodes I in the first row are turned on. Accordingly, the signal voltage for the transparent pixel electrode II written in the transparent pixel electrodes I is replaced by the signal voltage for the transparent pixel electrode I.

In this way, the properly corresponding signal voltage is first written in the transparent pixel electrodes II in the first row, the properly corresponding signal voltage is secondly written in the transparent pixel electrodes II in the second row, and the properly corresponding signal voltage is thirdly written in the transparent pixel electrodes I in the first row. By repeating this operation consecutively on successive rows, all the transparent pixel electrodes I and II are loaded with their properly corresponding signal voltages.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A display device comprising:

a plurality of gate line groups, each group consisting of at least two gate lines;

a plurality of signal lines intersecting the plural gate line groups; and a plurality of pixel electrodes includes first, second and third pixel electrodes disposed in the areas of the intersections between two adjacent gate lines and two adjacent signal lines, wherein each of the first, second and third pixel electrodes of the plural pixel electrodes are time-sequentially turned on at different times from one another by being supplied with the properly corresponding signal voltages from the signal lines by differentiating the states of voltages of the two adjacent gate lines being selected, wherein the signal voltages supplied to the first, second and third pixel electrodes are independently changeable respectively by differentiating the states of voltages of the two adjacent gate lines, the plurality of pixel electrodes are selectively actuated in response to the actuation of a plurality of TFTs connected therewith, the gate electrode of a first TFT which drives the first pixel electrode and the gate electrode of a third TFT which drives the third pixel electrode are connected with the preceding gate line of the two adjacent gate lines, the gate electrode of a second TFT which drives the second pixel electrode is connected with the following gate line of the two adjacent gate lines, the drain (or source) electrode of the second TFT which drives the second pixel electrode is connected with the source (or drain) electrode of the third TFT which drives the third pixel electrode through the second pixel electrode as the conductor line, the two adjacent gate lines are both driven to high level during the first sub-period T1 of three sub-periods into which one horizontal scanning period is time-sequentially divided so that the capacitances associated with the first, the second, and the third pixel electrodes are charged with the signal voltage during the sub-period T1 on the signal line connected with the third electrode, during the sub-period T2 that follows the sub-period T1, the preceding gate line remains at high level whereas the following gate line is driven to low level so that the signal voltage written in the first pixel electrode is replaced by the signal voltage during the sub-period T2 on the signal line which is connected with the first pixel electrode, during the sub-period T3 that follows the sub-period T2, the preceding gate line is driven to low level and the following gate line is driven to high level so that the signal voltage written in the second pixel electrode is replaced by the signal voltage during the sub-period T3 on the signal line which is connected with the second pixel elelectrode, the length of the sub-period T1 is longer than the length of the sub-period T2, the length of the sub-period T1 is longer than the length of the sub-period T3, the electric resistance of the second pixel electrode is larger than that of the conductor line of the signal line.

2. A display device as claimed in claim 1, wherein the drain of the first TFT and the drain of the second TFT are connected to the same signal line.

3. A display device as claimed in claim 1, wherein a plurality of transistors connected to the plural gate lines and the plural signal lines, wherein a signal transmission is carried out from one transistor to another transistor from the plurality of transistors by way of a pixel electrode.

4. A display device comprising:

a plurality of gate line groups, each group consisting of at least two gate lines;

a plurality of signal lines intersecting the plural gate line groups; and a plurality of pixel electrodes includes first, second and third pixel electrodes disposed in the areas of the intersections between two adjacent gate lines and two adjacent signal lines, wherein each of the first, second and third pixel electrodes of the plural pixel electrodes are time-sequentially turned on at different times from one another by being supplied with the properly corresponding signal voltages from the signal lines by differentiating the states of voltages of the two adjacent gate lines being selected, wherein each of the plural pixel electrodes consists of the first pixel electrode, the second pixel electrode and the third pixel electrode; the gate electrode of a first TFT for driving the first pixel electrode and the gate electrode of a third TFT for driving the third pixel electrode are connected with a preceding gate line; the gate electrode of a second TFT for driving the second pixel electrode is connected with a following gate line; and the second TFT and the third TFT are connected with each other, wherein the signal voltages supplied to the first, second and third pixel electrodes are independently changeable respectively by differentiating the states of voltages of the two adjacent gate lines, the plural pixel electrodes are selectively actuated in response to the actuation of the TFTs connected therewith, the gate electrode of the TFT which drives the first pixel electrode and the gate electrode of the TFT which drives the third pixel electrode are connected with the preceding gate line of the two adjacent gate lines, the gate electrode of the TFT which drives the second pixel electrode is connected with the following gate line of the two adjacent gate lines, the drain (or source) electrode of the TFT which drives the second pixel electrode is connected with the source (or drain) electrode of the TFT which drives the third pixel electrode through the second pixel electrode as the conductor line, the two adjacent gate lines are both driven to high level during the first sub-period T1 of three sub-periods into which one horizontal scanning period is time-sequentially divided so that the capacitances associated with the first, the second, and the third pixel electrodes are charged with the signal voltage during the sub-period T1 on the signal line connected with the third pixel electrode, during the sub-period T2 that follows the sub-period T1, the preceding gate line remains at high level whereas the following gate line is driven to low level so that the signal voltage written in the first pixel electrode is replaced by the signal voltage during the sub-period T2 on the signal line which is connected with the first pixel electrode, during the sub-period T3 that follows the sub-period T2, the preceding gate line is driven to low level and the following gate line is driven to high level so that the signal voltage written in the second pixel electrode is replaced by the signal voltage during the sub-period T3 on the signal line which is connected with the second pixel electrode, the length of the sub-period T1 is longer than the length of the sub-period T2, the length of the sub-period T1 is longer than the length of the sub-period T3, the electric resistance of the second pixel electrode is larger than that of the conductor line of the signal line.

5. A display device as claimed in claim 4, wherein the second TFT and the third TFT are connected with each other via the second pixel electrode.

6. A display device as claimed in claim 4, wherein the second TFT and the third TFT are directly connected with each other through the second pixel electrode.

7. A display device as claimed in claim 4, wherein the second TFT and the third TFT are connected with each other through the second pixel electrode, and wherein the source (or drain) of the second TFT and the source (or drain) of the third TFT are connected with each other through the second pixel electrode.

* * * * *